United States Patent [19]

Cruz et al.

[11] Patent Number: 4,785,254

[45] Date of Patent: Nov. 15, 1988

[54] PULSED PARTICLE BEAM VACUUM-TO-AIR INTERFACE

[75] Inventors: Gilbert E. Cruz, Pleasanton; William F. Edwards, Livermore, both of Calif.

[73] Assignee: The United States of America as represented by The United States Department of Energy, Washington, D.C.

[21] Appl. No.: 63,602

[22] Filed: Jun. 18, 1987

[51] Int. Cl.[4] ..... H05H 7/10

[52] U.S. Cl. ..... 328/233; 313/7; 313/146; 313/233; 313/363.1; 313/420; 315/349

[58] Field of Search ..... 313/363.1, 420, 7, 146, 313/233; 315/339, 349; 328/227, 233

[56] References Cited

U.S. PATENT DOCUMENTS

| | | | |
|---|---|---|---|
| 3,778,655 | 12/1973 | Luce | 313/363.1 |
| 4,162,432 | 7/1979 | Schlitt | 315/349 |
| 4,333,036 | 6/1982 | Farrell | 313/420 |

OTHER PUBLICATIONS

"A Vacuum-to-Air Interface for the Advanced Test Accelerator Beam Director", G. E. Cruz et al., Lawrence Livermore National Laboratory, UCRL-94686--Preprint, Jun. 27, 1986.

"A Vacuum-to-Air Interface for the Advanced Test Accelerator", G. E. Cruz et al., Lawrence Livermore National Laboratory, UCRL-95426-Preprint, Oct. 27, 1986.

*Primary Examiner*—Leo H. Boudreau
*Assistant Examiner*—K. Wieder
*Attorney, Agent, or Firm*—Gary C. Roth; L. E. Carnahan; Judson R. Hightower

[57] ABSTRACT

A vacuum-to-air interface (10) is provided for a high-powered, pulsed particle beam accelerator. The interface comprises a pneumatic high speed gate valve (18), from which extends a vacuum-tight duct (26), that termintes in an aperture (28). Means (32, 34, 36, 38, 40, 42, 44, 46, 48) are provided for periodically advancing a foil strip (30) across the aperture (28) at the repetition rate of the particle pulses. A pneumatically operated hollow sealing band (62) urges foil strip (30), when stationary, against and into the aperture (28). Gas pressure means (68, 70) periodically lift off and separate foil strip (30) from aperture (28), so that it may be readily advanced.

3 Claims, 4 Drawing Sheets

PULSED PARTICLE BEAM VACUUM-TO-AIR INTERFACE

The U.S. Government has rights in this invention pursuant to Contract No. W-7405-ENG-48 between the U.S. Department of Energy and the University of California for the operation of the Lawrence Livermore National Laboratory.

BACKGROUND OF THE INVENTION

The invention described herein relates generally to apparatus for providing a vacuum-to-air interface, and more particularly a high-powered pulsed particle beam vacuum-to-air interface capable of operating continuously at a high repetition rate.

Particle accelerators that are presently being designed and constructed will continuously provide extended sequences of high-powered particle pulses for long periods of time. As an example, the Advanced Test Accelerator (ATA) of the Lawrence Livermore National Laboratory will typically provide a 10,000 ampere, 50 MeV particle energy, electron beam emitted as individual 70 nanosecond full width at half maximum amplitude pulses occurring at a repetition rate of 1 Hz. In many of these new accelerators it will be necessary for the pulsed particle beam to pass from a region of near vacuum within the accelerator, such as at approximately $10^{-5}$ torr in the case of the ATA, directly into air at atmospheric pressure. In addition to maintaining the near vacuum within these machines at or below an acceptable pressure level, it will also be essential that the vacuum-to-air interfaces of the new accelerators not significantly alter any of the characteristic parameters of the individual pulses of the pulsed particle beams. Particularly because each of the particle pulses provided by these new accelerators will possess vastly more than enough energy to vaporize or disintegrate any material foil through which it passes, none of the presently known particle accelerator vacuum-to-air interfaces will be adequate for usage on the new machines.

As an example of a known particle accelerator vacuum-to-air interface, Luce, in U.S. Pat. No. 3,778,655 issued Dec. 11, 1973, describes a composite metal foil exit window for use in situations where atomic particles generated in an evacuated stucture are passed into a chemically reactive environment. The foil windows that are described would be ruptured by the individual particle pulses of a high-powered pulsed beam particle accelerator, such as the ATA, and thus could not provide vacuum protection for the interior of the accelerator.

Similarly, Farrel in U.S. Pat. No. 4,333,036 issued June 1, 1982 teaches an improved foil support for the exit window of a particle accelerator. Again, the foil window that is described would be ruptured by the high-powered particle pulses provided by continuously operating accelerators such as the ATA, and is thus not suitable for providing accelerator vacuum protection for machines of that type.

As another example of the prior art, Schlitt in U.S. Pat. No. 4,162,432 issued July 24, 1979, describes a metal foil perhaps 10 microns thick that comprises an interface for electrons in a relatively low-powered, repetitively pulsed electron beam machine. As in the two previous situations, this foil would be easily ruptured by the individual, high-powered particle pulser of accelerators such as the ATA, and thus could not provide vacuum protection for such high-powered machines.

Thus the problem remains of how to provide a vacuum-to-air interface, for a continuously operating high-powered pulsed particle beam accelerator, that maintains the vacuum level within the machine while, at the same time, not significantly altering any of the characteristic parameters of the individual particle pulses of the beam.

SUMMARY OF THE INVENTION

It is therefore an object of the invention to provide a vacuum-to-air interface for a pulsed particle beam accelerator.

Another object of the invention is to provide a vacuum-to-air interface for a continuously operating high-powered pulsed particle beam accelerator.

A further object of the invention is to provide a vacuum-to-air interface, for a continuously operating high-powered pulsed particle beam accelerator, that, while maintaining the vacuum level within the accelerator, does not significantly alter any of the characteristic parameters of the individual pulses of the pulsed particle beam.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purposes of the present invention, as embodied and broadly described herein, an inventive vacuum-to-air interface for a pulsed particle beam accelerator is provided. The interface is intended for use with accelerators that continuously generate sequences of individual high-powered particle pulses, at a fixed repetition rate, within the region of near vacuum existing within the accelerator. The new interface comprises a pneumatic high speed gate valve having an open and a closed configuration. In use, the gate valve should be positioned contiguously to the region of near vacuum within the accelerator. The gate valve should be located so that the sequence of particle pulses can pass through the valve when it is in its open configuration. The valve is operated at the fixed repetition rate of the particle pulse sequence. A duct extends from the gate valve and provides a vacuum-tight passageway for the particle pulses. The duct terminates in an aperture through which the particle pulses are allowed to pass. Means are provided for periodically advancing and positioning a strip of metal foil across the aperture of the duct, at the fixed repetition rate of the sequence of particle pulses. The foil strip is held stationary as each high-powered particle pulse, after first passing through the aperture, passes through and ruptures the foil strip. Following rupture, the foil strip is advanced so that a new portion of the foil strip extends across the aperture. When the foil strip is stationary, a sealing band that is pneumatically operated at the fixed repetition rate of the sequence of particle pulses, mechanically urges the foil strip against and into the aperture of the duct. This improves the quality of the vacuum seal that the foil strip provides across the aperture. The sealing band is centrally hollow, to thereby provide passage for the particle pulses. Means are provided for keeping the foil strip from crinkling as it is urged against and into the aperture of the duct. At the same time, this means also keeps the surrounding portions of the foil strip both stationary and flat. Prior to advancing the foil strip, and when the gate valve is in its closed configuration, means are provided, during every cycle of operation of the interface, for introducing an individual gas quantity into the passageway of the duct. The quantity of gas creates a pressure that lifts off and separates the foil strip from the aperture of the duct, so that the foil strip may then be readily advanced to a new position.

Preferably, the product formed by multiplying the fixed repetition rate of the sequence of particle pulses, times the volume defined by the vacuum-tight passageway of the duct, as bounded by the gate valve in its closed configuration and the foil strip when it is being urged against and into the aperture, is no more than 140 $cm^3$ per second.

It is also preferable if the individual gas quantities, of the foil lift off means, are comprised of air, nitrogen, or any mixture of air and nitrogen.

The benefits and advantages of the present invention, as embodied and broadly described herein, include, inter alia, the provision of a vacuum-to-air interface, for a continuously operating high-powered pulsed particle beam accelerator, that, while maintaining the vacuum level within the accelerator, does not significantly alter any of the characteristic parameters of the individual pulses of the pulsed particle beam.

BRIEF DESCRIPTON OF THE DRAWINGS

The accompanying drawings, which are incorporated herein and form a part of the specification, illustrate an embodiment of the invention and, together with the description, serve to explain the principles of the invention. In the drawings.

DETAILED DESCRIPTION OF THE INVENTION

Figure 1:
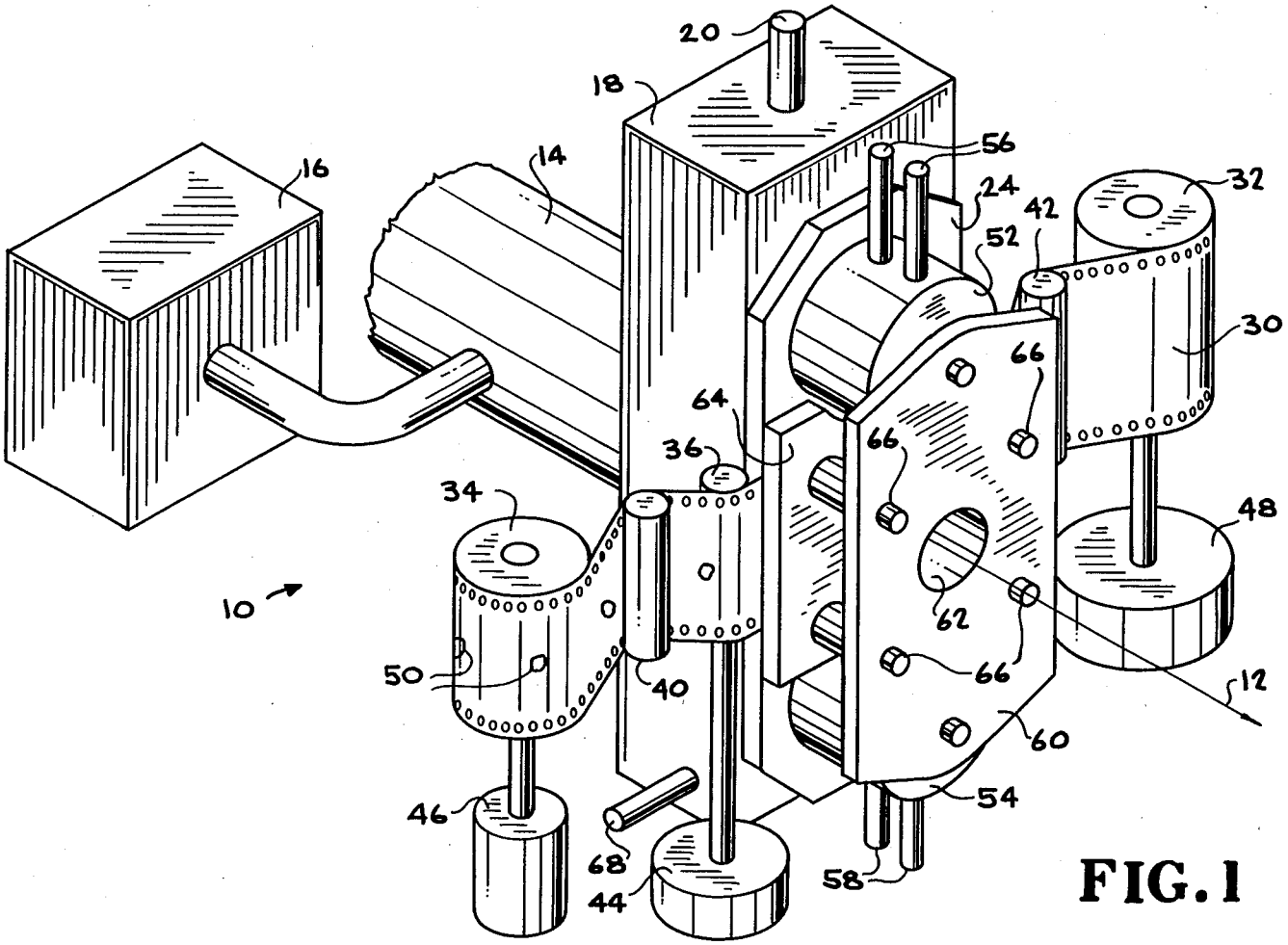
FIG. 1 is a perspective view of a vacuum-to-air interface for a pulsed particle beam accelarator, made in accordance with the invention.
Figure 2:
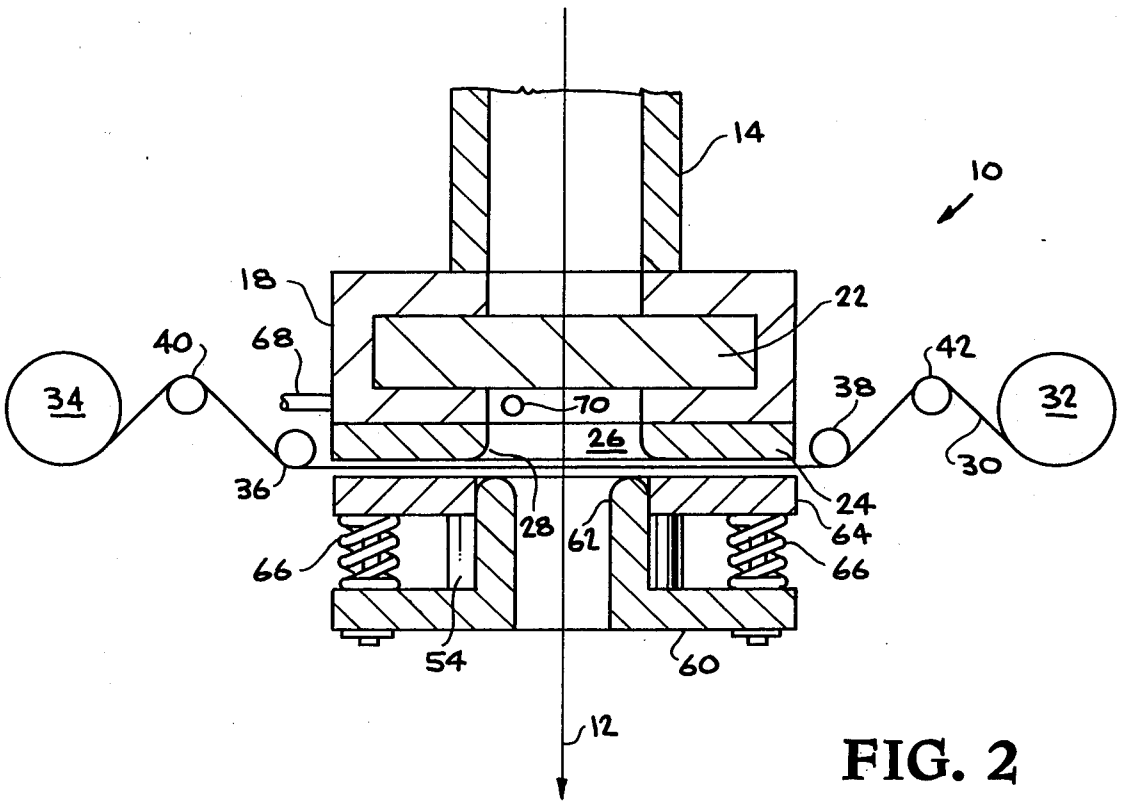
FIG. 2 is a cross-sectional top view of the vacuum-to-air interface of FIG. 1, taken generally along the particle beam axis of the accelerator.

Reference is now made in detail to the present preferred embodiment of the invention as illustrated in the accompanying drawings. Reference is made concurrently to FIGS. 1 to 5 which show a schematic and various top and side, cross-sectional, views of a vacuum-to-air interface, 10, for a pulsed particle beam accelerator, that is in accordance with the invention. A common system of reference numerals is used. The purpose of interface 10 is to permit a sequence of individual high-powered particle pulses, that are generated within a region of near vacuum existing within a related accelerator, not shown, and propagate along an accelerator particle beam axis 12, to exit the accelerator without contaminating the near vacuum within the accelerator, and without significant alteration of the characteristic parameters of the individual particle pulses. FIGS. 2 to 5 are each taken generally along accelerator particle beam axis 12.

Figure 4:
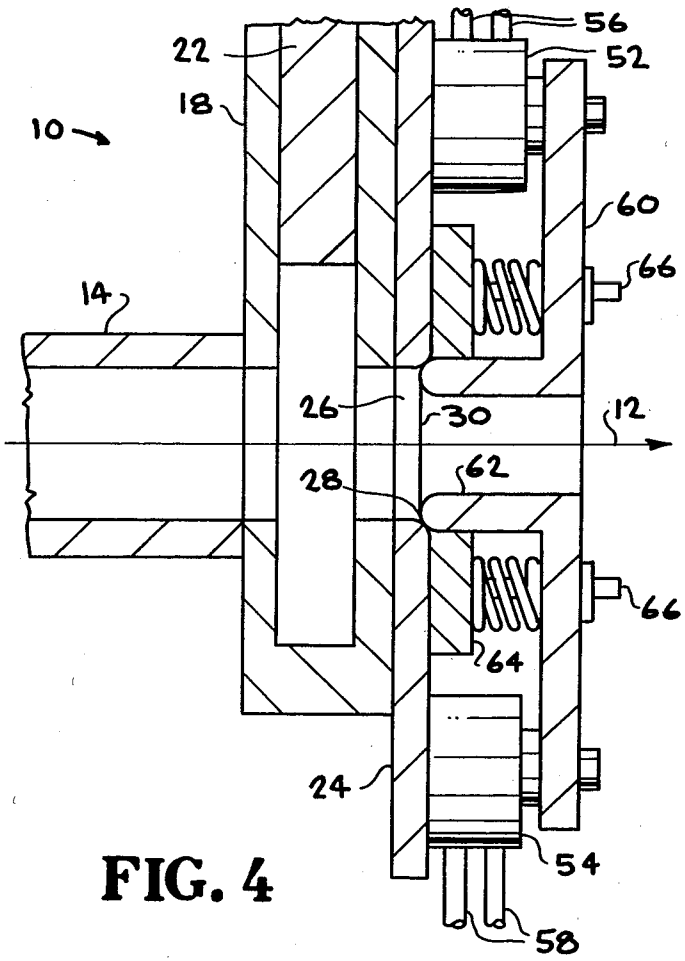
FIG. 4 is a cross-sectional side view of the vacuum-to-air interface of FIG. 1 in open configuration, taken generally along the particle beam axis of the accelerator.
Figure 3:
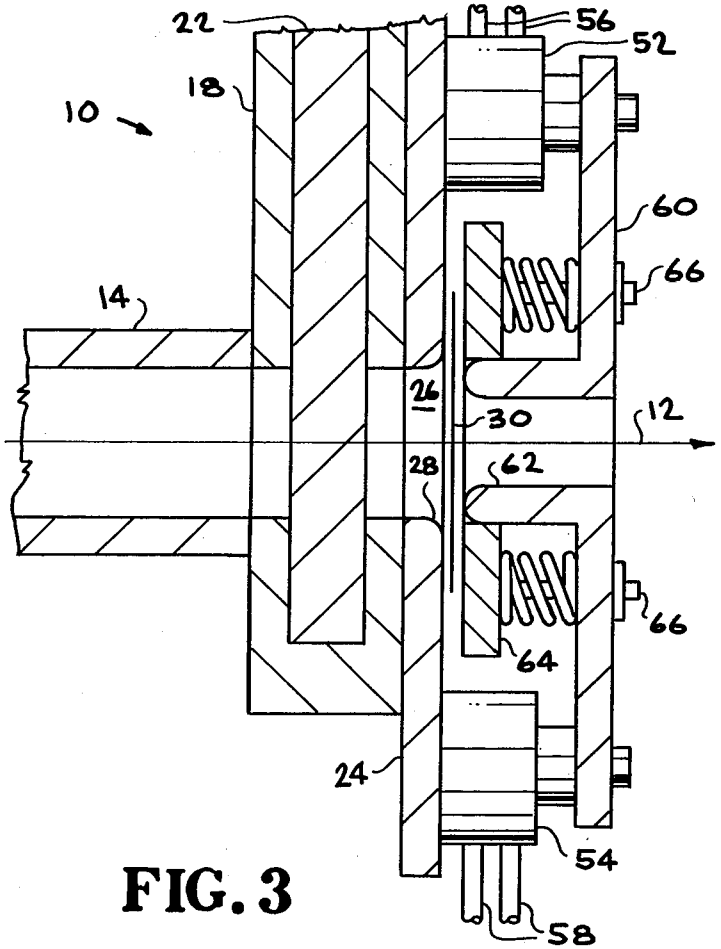
FIG. 3 is a cross-sectional side view of the vacuum-to-air interface of FIG. 1 in closed configuration, taken generally along the particle beam axis of the accelerator.

The sequence of particle pulses, generated at a fixed repetition rate, propagate along beam axis 12, that is within an evacuated pipe 14. Pipe 14 is evacuated by vacuum system 16, that is schematically indicated. Vacuum systems, such as system 16, are very well known in the arts related to accelerator technology. Typically, vacuum system 16 produces a vacuum of approximately $10^{-5}$ torr within pipe 14. Pipe 14 terminates in a pneumatic high speed gate valve 18, that is operated by a gate valve pneumatic line 20, and contains a gate valve sliding vacuum barrier 22. Pneumatic high speed gate valves are well known in the mechanical and related arts, and are supplied by many commercial sources such as VAT Incorporated, of Woburn, Maine, among others. Gate valve 18 is shown in a closed configuration in FIG. 3, where sliding vacuum barrier 22 extends across particle beam axis 12. In FIG. 4 gate valve 18 is in an open configuration, wherein sliding vacuum barrier 22 is withdrawn from particle beam axis 12, that permits the high-powered particle pulses of the related accelerator to pass through gate valve 18. In operation, gate valve 18 is operated by pneumatic line 20 at the same fixed repetition rate at which the sequence of particle pulses in produced by the related accelerator. The means by which gate valve 18 may be operated to achieve this synchronism are well understood in the mechanical, accelerator, and related arts.

A mounting plate 24 is attached to gate value 18, on the opposite side from pipe 14. The interior of plate 24 provides a duct 26 that terminates in an aperature 28, with duct 26 and aperture 28 providing a vacuum-tight passageway for the particle pulses after they leave gate valve 18. It is particularly noted that the volume of duct 26 should be as small as possible. The reasons for this are discussed below.

A strip of a metal or plastic foil 30, that is unwound from a reel 32 and taken up on a spool 34, is periodically advanced across aperture 28 at the fixed repetition rate of the sequence of particle pulses. The inventors have found that titanium and the well known commercial plastic Kapton, each in thicknesses within the approximate range from 4 to 5 mils, are particularly well suited for use as foil strip 30, but it is anticipated that many other varieties of metal or plastic foil strip of various thickness may be beneficially used in the practice of this invention. Foil strip 30 remains stationary as each individual high-powered particle pulse first passes through aperture 28 and then passes through and ruptures foil strip 30. Following each rupture, foil strip 30 is advanced to a new position in which the portion of foil strip 30 that extends across aperture 28 is not ruptured, and the process is then repeated. As particularly shown in FIGS. 1 and 2, the means by which foil strip 30 is advanced and positioned are provided by a pair of sprocket spools 36 and 38, and a pair of tension spools 40 and 42, as driven by a stepping drive motor 44, and as assisted by a take up motor 46 and a brake 48. However, the invention is not limited by the particular methodology shown, and many other means for advancing and positioning foil strip 30 may be beneficially employed in the various situations that may arise in conjunction with the practice of this invention. Since the inventive vacuum-to-air interface is intended for use on high-powered particle accelerators such as the ATA of the Lawrence Livermore National Laboratory, the relevant specifications of which are given above, each high-powered particle pulse can easily pass through and rupture foil strip 30 without any of its characteristic parameters, such as pulse amplitude, width, power, and so on, being significantly altered. Holes 50, in foil strip 30, produced by particle beam rupture, are shown in FIG. 1.

Figure 5:
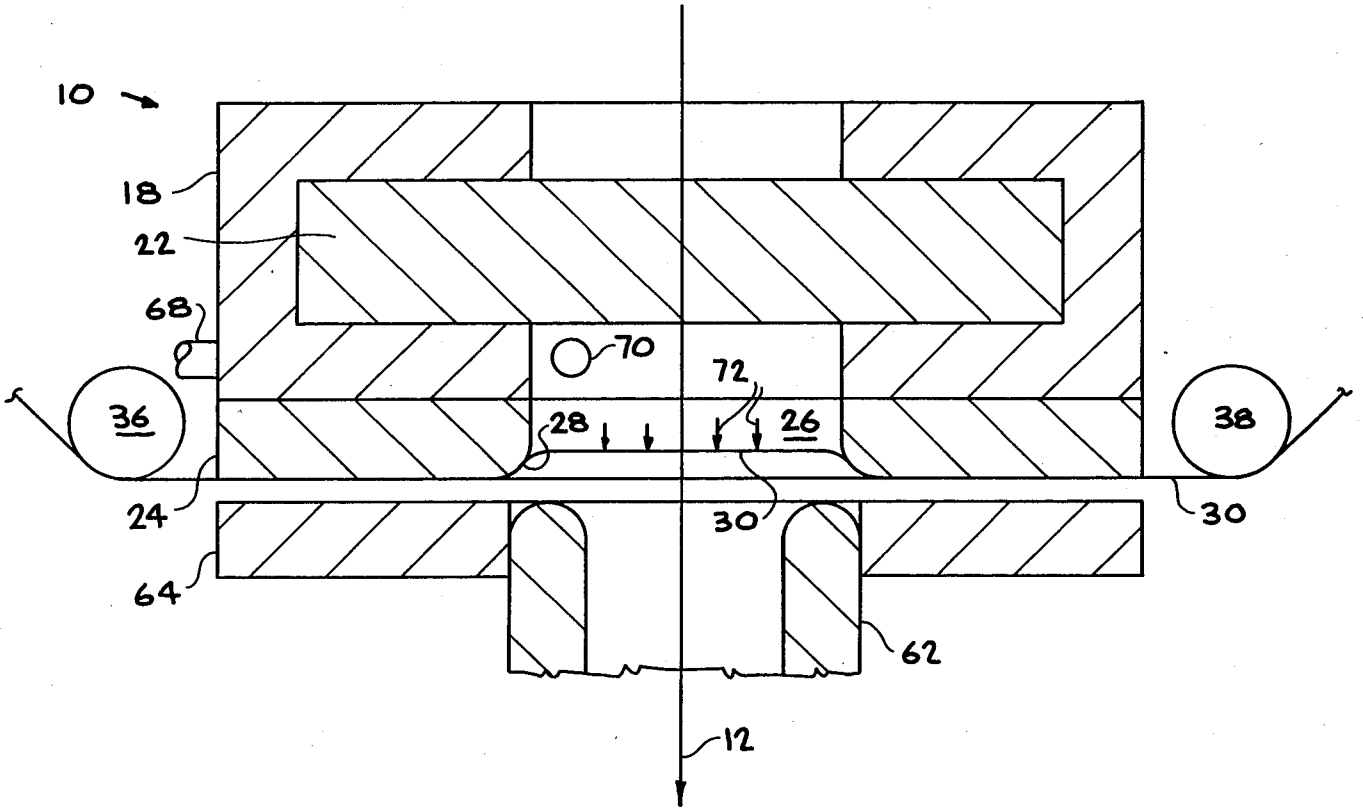
FIG. 5 is a partial cross-sectional top view of the vacuum-to-air interface of FIG. 1, taken generally along the particle beam axis of the accelerator, and illustrating the gas pressure-operated foil lift off and separation means of the interface.

A pair of double acting air cylinders, 52 and 54, are mounted upon mounting plate 24. Air cylinders 52 and 54 are driven by a pair of dual air lines 56 and 58. Air cylinders 52 and 54 support and control the motion of a seal plate 60, the central portion of which comprises a hollow sealing band 62. As shown, sealing band 62 is pneumatically driven by air cylinders 52 and 54, at the fixed repetition rate of the sequence of particle pulses produced by the related accelerator, to urge foil strip 30, when it is stationary, into and against aperture 28 of duct 26. This vastly improves the quality of the vacuum seal, which foil strip 30 provides across aperture 28, for the interior passageway for particle pulses that is provided by duct 26. Sealing band 62 is hollow so that the particle pulses may unimpedely pass therethrough, along particle beam axis 12. As a further component of the sealing mechanism, seal plate 60 supports a pressure plate 64, on a plurality of four spring supports 66. As particularly shown in FIG. 4, when seal plate 60 and sealing band 62 are retracted or brought toward mounting plate 24 and aperture 28 by air cylinders 52 and 54, pressure plate 64 is caused, by spring supports 66, to compressively urge foil strip 30 upon mounting plate 24. This provides a means for keeping foil strip 30 from crinkling, that is to say from forming into many short bends and turns, as it is urged into aperture 28. It also provides a means for keeping foil strip 30 stationary and flat in the area adjacent to aperture 28. Following every rupture of foil strip 30, by a particle beam pulse, air cylinders 52 and 54 separate seal plate 62, and the apparatus attached thereto, away from mounting plate 24, so that foil strip 30 is no longer physically constrained in position. However, as shown in FIG. 5, at this time foil strip 30 is smoothly indented into aperture 28, and is thus not free to be readily moved to a new position.

Vacuum-to-air interface 10 provides a means for lifting off and separating foil strip 30 from aperture 28 of duct 26, as well as from mounting plate 24, so that foil strip 30 may be readily advanced to a new position. This is accomplished by a compressed gas input line 68 which, via a passage outlet 70, introduces a sequence of individual gas quantities into the interior passageway of duct 26, at the fixed repetition rate of the sequence of particle pulses that are provided by the related accelerator. Each individual gas quantity is introduced into duct 26 only when gate valve 18 is in its closed configuration, and prior to foil strip 30 being advanced to a new position. Each individual quantity of introduced gas produces a pressure, indicated by a plurality of pressure arrows 72 in FIG. 5, that lifts off and separates foil strip 30 from aperture 30 and related apparatus, so that foil strip 30 is free to move to a new position. Preferably, the gas quantities are comprised of air, nitrogen, or any mixture of air and nitrogen. However, in other applications other gases may be used.

During every cycle of operation of vacuum-to-air interface 10, an amount of air at atmospheric pressure, of volume equal to that of the vacuum-tight passageway within duct 26, as bounded by gate valve 18 in closed configuration and foil strip 30 when urged against and into aperture 28, is admitted into evacuated pipe 14. This volume, multiplied by the fixed repetition rate of the sequence of particle pulses produced by the related accelerator, is the volume per unit time of air at atmospheric pressure that vacuum system 16 must continuously eliminate from the interior of pipe 14 for the vacuum level of the interior of the related accelerator to be constantly maintained. Preferably, this volume per unit time should be no more than approximately 140 $cm^3$ per second. It is noted that by greatly improving vacuum system 16, larger volumes of contaminant air per unit time may be accommodated. Nevertheless, it is always advantageous to minimize the volume of the passageway provided by duct 26.

It is thus appreciated that in accordance with the invention as herein described and shown in FIGS. 1 to 5, a vacuum-to-air interface for a continuously operating high-powered pulsed particle beam accelerator, that maintains the vacuum level within the accelerator while not significantly altering any of the characteristic parameters of the individual pulses of the pulsed particle beam, is provided.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the inventive vacuum-to-air interface of this invention may be adapted to accommodate particle pulses that are generated at a variable repetition rate. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A vacuum-to-air interface for a pulsed particle beam accelerator of the type that, within a region of near vacuum existing within the accelerator, in operation continuously generates a sequence of individual high-powered particle pulses at a fixed repetition rate, the interface comprising:

a pneumatic high speed gate valve having an open configuration and a closed configuration and adapted to be positioned contiguously to the region of near vacuum existing within the accelerator at a location where the sequence of particle pulses can pass through the gate valve in open configuration, and with the gate valve additionally adapted to be operated at the fixed repetition rate of the sequence of particle pulses;

a duct extending from the gate valve and terminating in an aperture, and providing a vacuum-tight passageway for the particle pulses after the particles pass through the gate valve in open configuration and then proceed onward toward and through the aperture;

advancing and positioning means, for periodically advancing a strip of metal or plastic foil across the aperture of the duct at the fixed repetition rate of the sequence of particle pulses, in a manner insuring that the foil strip remains stationary as each of the individual high-powered particle pulses passes through the aperture and then passes through and ruptures the foil strip, and further providing that following each rupture the foil strip is then advanced to a new position in which the portion of the foil strip that extends across the aperture is not ruptured;

a sealing band, adapted to be pneumatically operated at the fixed repetition rate of the sequence of particle pulses, for mechanically urging the foil strip, when stationary, against and into the aperture of the duct, to thereby improve the quality of the vacuum seal that the foil strip provides across the aperture for the interior passageway of the duct, with the sealing band being centrally hollow to permit the sequence of particle pulses to pass therethrough;

a means for keeping the foil strip from crinkling as it is being urged into the aperture, and, at the same time, for keeping the portion of the foil strip adjacent to that portion being so urged both stationary and flat; and a means for introducing a sequence of individual gas quantities into the passageway of the duct, at the fixed repetition rate of the sequence of particle pulses, and with each individual gas quantity being introduced only when the gate valve is in the closed configuration and prior to the advancing and positioning means beginning to advance the foil strip to a new position, whereby the gas pressure of the gas quantity lifts off and separates the foil strip from the aperture of the duct so that the foil strip may be readily advanced.

2. A vacuum-to-air interface, as recited in claim 1, in which the product formed by multiplying the fixed repetition rate of the sequence of particle pulses times a volume defined by the vacuum-tight passageway, bounded by the gate valve in closed configuration and the foil strip when urged against and into the aperture, is no more than approximately 140 $cm^3$ per second.

3. A vacuum-to-air interface, as recited in caim 1 in which the sequence of individual gas quantities is comprised of air, nitrogen, or any mixture of air and nitrogen.

* * * * *